United States Patent [19]

Jenkins

[11] 4,265,174

[45] May 5, 1981

[54] ENDLESS PRINTING BAND AND SUPPORT ASSEMBLY

[75] Inventor: William A. Jenkins, Englewood, Ohio

[73] Assignee: Monarch Marking Systems, Inc., Dayton, Ohio

[21] Appl. No.: 960,911

[22] Filed: Nov. 15, 1978

[51] Int. Cl.[3] ..... B41J 1/20

[52] U.S. Cl. ..... 101/111; 101/90

[58] Field of Search ..... 101/90, 93.14, 93.38, 101/93.11, 93.39, 110, 111, 105

[56] References Cited

U.S. PATENT DOCUMENTS

| | | | |
|---|---|---|---|
| D. 238,205 | 12/1975 | Pabodie | D64/10 |
| 542,358 | 7/1895 | Carter | 101/90 X |
| 642,389 | 1/1900 | Turck | 101/90 X |
| 1,049,908 | 1/1913 | Pannier | 101/110 X |
| 2,101,444 | 12/1937 | Miles | 101/111 |
| 3,465,866 | 9/1969 | Gehring et al. | 101/90 X |
| 3,750,565 | 8/1973 | Hubbard et al. | 101/111 X |
| 3,977,321 | 8/1976 | Pabodie | 101/111 |
| 4,081,309 | 3/1978 | Jenkins | 156/250 |
| 4,094,244 | 6/1978 | Edwards et al. | 101/66 |
| 4,163,422 | 8/1979 | Hamisch | 101/111 |

*Primary Examiner*—Edward M. Coven
*Attorney, Agent, or Firm*—Jacox & Meckstroth

[57] ABSTRACT

A set of flexible endless printing bands are arranged in two rows spaced in tandem relation for simultaneously printing two lines of characters. Each band in each row is supported by a corresponding indexing gear which includes a thin flange portion projecting outwardly between adjacent bands. A row of corresponding idle gears is disposed between the rows of printing bands, and each idle gear connects the two indexing gears supporting a corresponding set of bands in the two rows. A band indexing mechanism is axially movable within one row of indexing gears and provides for simultaneously indexing each set of corresponding printing bands. Each endless printing band may be molded with a series of long pads each supporting a numerical printing character and integrally connected by thin flexible link portions and short pads carrying visually readable characters. Two non-numerical printing characters are carried by relatively shorter pads which are integrally connected by an elongated link forming a visually readable blank within the printing band.

8 Claims, 6 Drawing Figures

ENDLESS PRINTING BAND AND SUPPORT ASSEMBLY

BACKGROUND OF THE INVENTION

In the field of printers for labels, tags and the like, including for example, a hand operated portable label printer and dispenser such as disclosed in U.S. Pat. No. 4,081,309 which issued to the Assignee of the present invention, it is frequently desirable to provide for simultaneously printing two lines of characters. One form of two line printer includes two banks or rows of flexible endless printing bands which are supported in tandem relation, such as shown in FIG. 66 of the above patent. Preferably, each of the endless printing bands is formed by a series of pads which are integrally connected by thin flexible hinge or link portions, and the pads carry a series of raised printing characters. For example, the characters may be numerical characters or non-numeric characters such as symbols. The endless printing bands also frequently include a series of human or visually readable characters in addition to the printing characters, and the visually readable characters may be formed on relatively thinner pads which may be disposed alternately between the pads having raised printing characters.

As disclosed in U.S. Design Pat. No. 238,205 which issued to the Assignee of the present invention, a printing character may also be in the form of a code such as the universal product code used in connection with consumer products. When one group or row of printing bands is used for printing a code such as a bar code and the other group or row of endless printing bands are used for printing numerical characters which correspond to the printed code characters, it is important that the printed line of code characters correspond correctly with the printed line of numerical characters to avoid printing errors. Such errors may easily occur when the printing bands in each row are individually indexed for selecting a predetermined character. In the bar code printer disclosed in U.S. Pat. No. 4,094,244, rotary printing wheels or gears mesh with each other to avoid scribing a bar code which does not correspond to the printed numerical characters.

SUMMARY OF THE INVENTION

The present invention is directed to an improved printing head assembly which is ideally suited for use on label printing and dispensing apparatus, but which may also be used in other printing machines or apparatus. As a primary feature, the printing head assembly assures that corresponding endless printing bands on a dual line printing head are accurately set and further provides for simultaneously indexing each set of corresponding printing bands for conveniently and quickly selecting the desired printing characters. As a result, the printing head assembly of the present invention assures that when the numerical printing bands on a dual line printing head are changed for printing a different number, the other line of printed code characters will correctly correspond to the printed line of numerical characters. The present invention also provides for an improved flexible endless printing band having large numerical printing characters while mimimizing the peripheral length of the band.

The above features and advantages and other features and advantages of the invention will be apparent from the following description, the accompanying drawings and the appended claims.

DESCRIPTION OF THE PREFERRED EMBODIMENT

Figure 1:
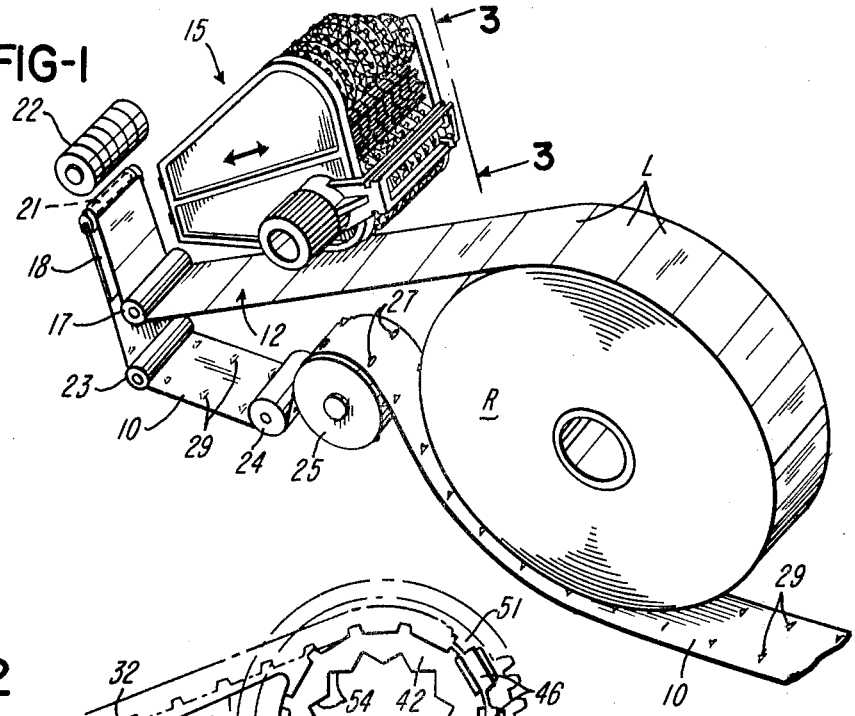
FIG. 1 is a diagrammatic perspective view of the major components of label printing and dispensing apparatus incorporating an improved printing head assembly constructed in accordance with the invention.

FIG. 1 illustrates generally certain major components of a hand carried and hand operated label printing and dispensing unit wherein pressure sensitive labels L are releasably attached to a carrier strip or web 10 to form a composite label web 12 which extends from a supply roll R supported for rotation by a rotatable spindle member. The composite label web 12 extends past a print head assembly 15 which is supported by parallel tracks for linear movement, for example, as shown in above-mentioned U.S. Pat. No. 4,081,309. The composite label web 12 then extends around a guide roll 17 upwardly across a rigid platen 18 and around a delaminating roll 21 where each label L is stripped or peeled from the carrier web 10 after the label is printed by linear movement of the print head assembly 15 towards the platen 18.

As each label L is stripped from the carrier web 10 at the delaminating roll 21, the label engages an applicating roll 22 which serves to press the pressure sensitive label onto the article receiving the label. From the delaminating roll 21, the carrier web 10 extends downwardly around a set of guide rolls 23 and 24 to a feed roll or wheel 25 which is rotatably indexed after each label is printed in order to pull or advance the carrier web 10 around the delaminating roll 21 for stripping the printed label from the carrier web. Preferably, the feed wheel 25 includes peripherally spaced teeth 27 which enter the web 10 at cuts 29 within the carrier web 10 for positively engaging the carrier web to assure advancement of the web with the wheel. One form of hand activated mechanism for reciprocating the print head assembly 15 and alternately advancing the label web 12 by rotatably indexing the feed wheel 25, is disclosed in above-mentioned U.S. Pat. No. 4,081,309.

In accordance with the present invention, the print head assembly 15 includes a pair of generally triangular-shaped frame portions or members 32 (FIG. 2) which are preferably integrally molded of a plastics material and project from an integrally molded base and track portion 33 (FIG. 4) such as shown in FIG. 66 of above-mentioned U.S. Pat. No. 4,081,309. Each of the frame members 32 has one end with a flat rectangular surface 34 and an opposite end with a series of laterally spaced arcuate surfaces or saddles 36 (FIGS. 2 & 4) formed between a series of laterally spaced slots 38.

Figure 2:
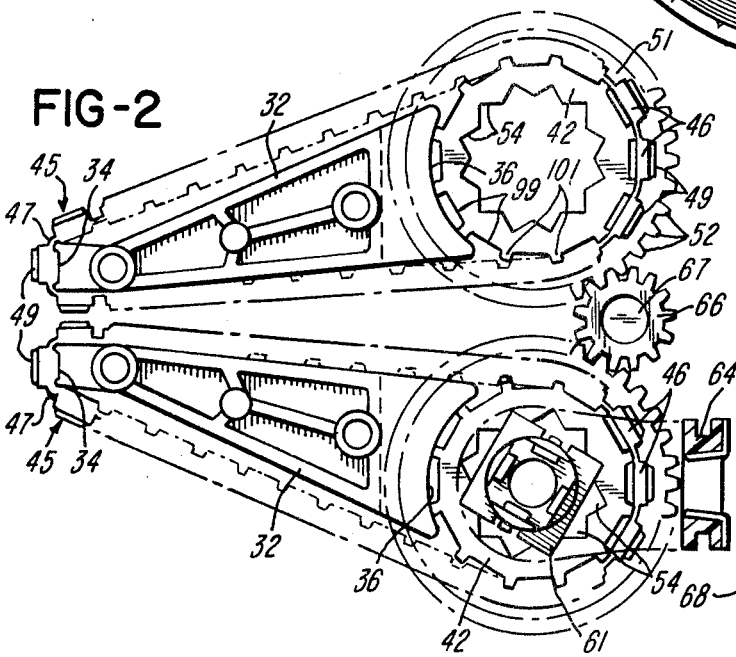
FIG. 2 is an axial end view of the printing head assembly shown in FIG. 1, but with portions broken away for purpose of clarity.

A plurality of indexing wheels or gears 42 (FIG. 4) are rotatably supported by the corresponding and mating arcuate surfaces or saddles 36, and each indexing gear 42 supports a corresponding endless flexible printing band 45. As illustrated in FIG. 2, each of the printing bands 45 is formed by a series of blocks or pads 46 integrally connected by flexible hinge or link portions 47, and the pads have outwardly projecting printing or visually readable characters 49. The flexible printing bands may also be constructed as will be described later in connection with FIGS. 5 and 6.

Referring again to FIGS. 2 and 4, each of the indexing gears 42 includes a relatively thin flange portion 51 which projects radially outwardly between the adjacent endless printing bands 45, and each flange portion 51 has peripherally spaced gear teeth 52. Each of the indexing gears 42 also has a center aperture or opening which is defined by circumferentially spaced V-shaped notches 54.

A manually operated hand indexing mechanism 55 (FIG. 4) includes a tubular member 58 having a knob portion 59 and extending axially into one row of indexing gears 42. The inner portion of the tubular member 58 is coupled to a generally square fitting 61 which is adapted to engage a set of notches 54 within a selected one of the indexing gears 42. As described in abovementioned U.S. Pat. No. 4,081,309, the indexing mechanism 55 is adapted to be moved axially within the row of indexing gears 42 and has a pair of diametrically opposed spring fingers 62 which selectively engage annular recesses 63 defined between the adjacent indexing gears 42 to form detents for locating the indexing mechanism 55 in registration with each printing band 45. The band indexing mechanism 55 also carries a rectangular frame portion 64 which defines a rectangular opening for viewing the visually readable characters on the lower set or group of printing bands 45 (FIG. 2).

Figure 3:
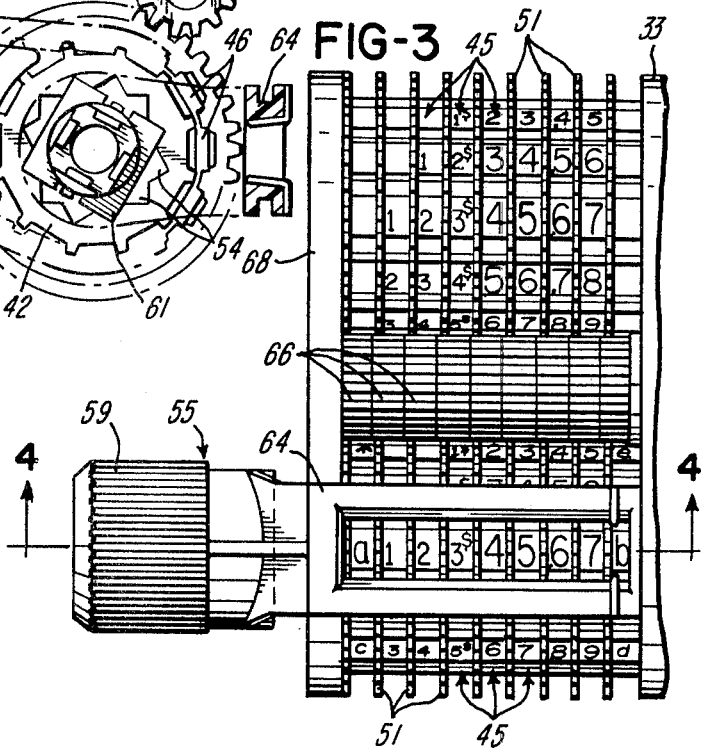
FIG. 3 is a top view of the printing head assembly shown in FIGS. 1 and 2 as taken generally on the line 3—3 of FIG. 1.
Figure 4:
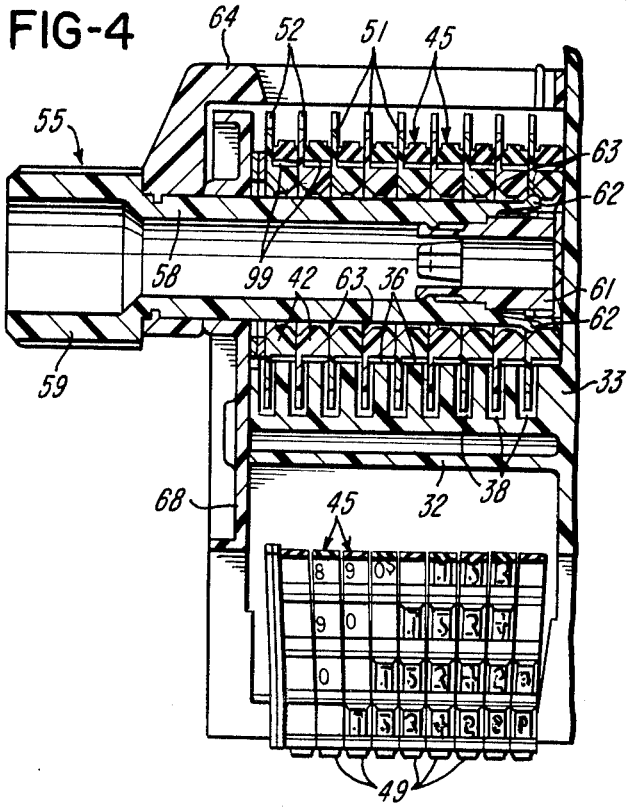
FIG. 4 is a section of the printing head assembly as taken generally on the line 4—4 of FIG. 3.

As shown in FIGS. 2 and 3, a row of axially aligned idle gears 66 are individually supported for rotation by a center shaft 67 which projects from the base and track portion 33. Each idle gear 66 meshes with the gear teeth 52 on the corresponding set or pair of upper and lower indexing gears 42. The assembly of gears 66, indexing gears 42, printing bands 45 and the indexing mechanism 55 are retained on the corresponding frame members 32 by a cover plate or member 68 (FIG. 4). When it is desired to index one of the endless printing bands 44 of the lower group of printing bands to present to the end surface 34 a different numerical character to be printed, the indexing mechanism 55 is positioned axially to the selected printing band, and the tube 58 and corresponding indexing gear 42 are rotated by turning the knob 59. As the endless printing band 45 within the lower group of bands (FIG. 2) is indexed, the corresponding printing band in the upper group is automatically and simultaneously indexed so that a corresponding printing character is positioned at the corresponding end surface 34 for printing.

As mentioned above, the endless printing head assembly described above in connection with FIGS. 2–4, is ideally suited for simultaneously printing numerical characters and corresponding machine readable bar code characters on one label, ticket or tag. For example, each of the endless printing bands forming the lower group of bands in FIG. 2 may carry a series of numerical printing characters and corresponding numerical visually readable characters which can be viewed through the frame 64 of the band indexing mechanism 55. The corresponding endless printing bands within the upper group of bands may each carry a series of machine readable parallel bar codes which are automatically presented for printing when the corresponding numerical character is presented by indexing the printing band of the lower group of bands shown in FIG. 2. Each of the bands in the upper row may also carry visually readable characters to aid in assembling the bands in the printing head 15 with proper relative orientation.

Figure 5:
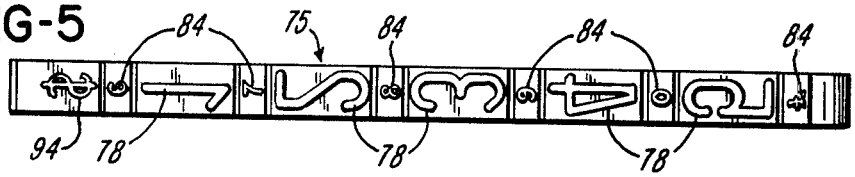
FIG. 5 is a plan view of an endless printing band constructed in accordance with the invention and adapted for use in the printing head assembly shown in FIGS. 1–4.
Figure 6:
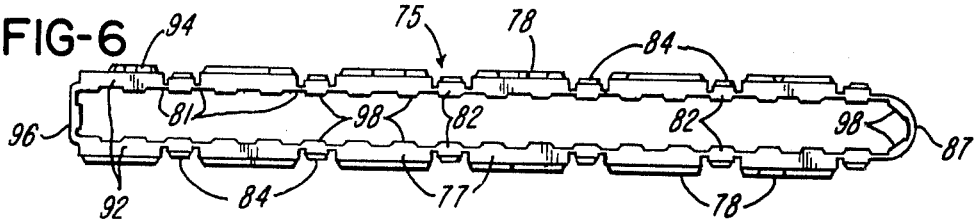
FIG. 6 is an edge view of the endless printing band shown in FIG. 5.

Referring to FIGS. 5 and 6, an endless printing band 75 includes a series of peripherally spaced elongated blocks or pads 77 each of which has a raised numerical printing character 78. The pads 77 are integrally connected by thin flexible hinge or link portions 81 to a series of intermediate short blocks or pads 82 each of which carries a visually readable character 84. At the right end (FIG. 6) of the molded endless printing band 75, two adjacent or successive pads 82 are integrally connected by an elongated flexible link portion 87 which forms a printing blank in the band and is in a rounded or U-shaped configuration when the band is molded.

At the opposite or left end (FIG. 6) of the printing band 75, two of the pads 82 are integrally connected by hinge or link portions 81 to corresponding elongated blocks or pads 92 which have a length shorter than the length of the pads 77. At least one of the pads 92 carries a raised non-numerical printing character 94 such as, for example, the dollar sign symbol shown in FIG. 5. The pads 92 are integrally connected by an elongated flexible link portion 96 which forms a visually readable blank in the printing band opposite to the printing blank formed by the flexible link portion 87.

Thus all of the elongated pads 77 and 92 which carry printing characters are alternately connected by visually readable characters or blanks in the endless printing band. The particular construction of the printing band 75 provides for obtaining large numerical printing characters, as shown in FIG. 5, in conbination with intermediate visually readable characters and while minimizing the peripheral length of the printing band 75. This is accomplished by molding the pads 92 with a length shorter than the pads 77 and by using one or both of the pads 92 to carry non-numerical printing characters which are usually required on a band with numerical characters.

As illustrated, each of the printing characters 78 and 94 on the printing band 75 is located in a diametrically opposite position to its corresponding visually readable character carried by one of the pads 82. For example, the lower pad 82 at the right end (FIG. 6) of the printing band 75 carries a visually readable character in the form of a dollar sign symbol, and the shorter upper pad 92 at the left end of the printing band carries the corresponding raised printing character of a dollar sign symbol. As also shown in FIG. 6, the endless band 75 is provided with a series of uniformly spaced teeth 98 which project inwardly for engaging uniformly spaced notches or recesses on an indexing wheel or gear such as the recesses 99 (FIG. 4) defined between the lugs 101 on the indexing gears 42 described above.

While the form of endless band printing apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. A printing head assembly adapted for use in a compact handheld label printing and dispensing apparatus, comprising a first row of flexible endless printing bands arranged in side-by-side relation, a second row of flexible endless printing bands arranged in side-by-side relation and spaced from the first row in tandem relation, the corresponding printing bands in the first and second rows having corresponding peripherally spaced raised printing characters, guide means within the printing bands and forming a printing station, a corresponding annular indexing gear within each of the printing bands and cooperating with the guide means to support the band, the indexing gears including corresponding gear teeth disposed between the adjacent endless printing bands and forming narrow spaces between the bands, a row of corresponding transfer gears disposed between the first and second rows of printing bands and connecting the gear teeth of the indexing gears for the bands in the first row with the gear teeth of the indexing gears for the corresponding bands in the second row to effect simultaneous indexing of each set of two corresponding bands within the first and second rows, and setting means supported for both axial and rotary movement within the indexing gears for one of the row of bands for indexing each set of corresponding indexing gears to present different sets of characters for printing.

2. A printing head assembly as defined in claim 1 wherein the endless printing bands within each row converge together in a direction extending from the indexing gears toward the guide means.

3. A printing head as defined in claim 1 wherein each of said transfer gears has a width greater than the width of the gear teeth of the corresponding indexing gears.

4. A printing head assembly as defined in claim 1 wherein at least one of the endless printing bands includes relative thin flexible link portions connecting printing character portions to visually readable portions, and a substantially longer elongated thin flexible link portion forming a visually readable blank space adjacent a non-numerical raised printing character.

5. A printing head assembly as defined in claim 1 wherein the row of transfer gears are supported for separate and independent rotation on a common shaft disposed generally between the first and second rows of printing bands.

6. A printing head assembly as defined in claim 1 wherein the raised printing characters on at least one of the endless printing bands are supported by a series of corresponding pads integrally connected by relatively thin flexible link portions, at least two immediately successive pads each having a peripheral length less than the length of the adjacent pads, and the two pads are directly connected by an elongated thin flexible link portion forming a non-printing blank within the endless band.

7. A printing head assembly adapted for use in a compact handheld label printing and dispensing apparatus, comprising a first row of flexible endless printing bands arranged in side-by-side relation, a second row of flexible endless printing bands arranged in side-by-side relation and spaced from the first row in tandem relation, the corresponding printing bands in the first and second rows having corresponding peripherally spaced raised printing characters, a corresponding indexing gear within each of the printing bands and supporting the band, each of the indexing gears including a generally cylindrical portion and a thin flange portion projecting radially outwardly from between the adjacent endless printing bands and having peripherally spaced teeth outboard of the bands, a row of axially spaced saddles supporting the cylindrical portions of the indexing gear for independent rotation, a row of corresponding transfer gears disposed between the first and second rows of printing bands and connecting the flange portions of the indexing gears for the bands in the first row with the flange portions of the indexing gears for the corresponding bands in the second row to effect simultaneous indexing of each set of two corresponding bands within the first and second rows, and means for rotating the indexing gears for one of the rows of bands for indexing each set of corresponding indexing gears to present different sets of characters for printing.

8. A printing head as defined in claim 7 wherein the cylindrical portion and thin flange portion of each indexing gear are integrally connected and comprise a molded plastics material.

* * * * *